US011426722B2

(12) United States Patent
Nguyen et al.

(10) Patent No.: US 11,426,722 B2
(45) Date of Patent: Aug. 30, 2022

(54) SPECIMEN TESTER INCLUDING A SEPARATE INITIATOR AND METHOD

(71) Applicants: Phuong Nguyen, San Diego, CA (US); John D. Buchaca, San Diego, CA (US)

(72) Inventors: Phuong Nguyen, San Diego, CA (US); John D. Buchaca, San Diego, CA (US)

( * ) Notice: Subject to any disclaimer, the term of this patent is extended or adjusted under 35 U.S.C. 154(b) by 306 days.

(21) Appl. No.: 16/432,832

(22) Filed: Jun. 5, 2019

(65) Prior Publication Data

US 2020/0384458 A1 Dec. 10, 2020

(51) Int. Cl.
*B01L 3/00* (2006.01)

(52) U.S. Cl.
CPC ..... *B01L 3/502* (2013.01); *B01L 3/563* (2013.01); *B01L 3/565* (2013.01); *B01L 2200/0689* (2013.01); *B01L 2200/141* (2013.01); *B01L 2300/025* (2013.01); *B01L 2300/044* (2013.01); *B01L 2300/0672* (2013.01); *B01L 2300/0681* (2013.01); *B01L 2300/16* (2013.01); *B01L 2300/168* (2013.01)

(58) Field of Classification Search
CPC ..... B01L 3/502; B01L 3/563; B01L 3/565; B01L 2200/0689; B01L 2200/141; B01L 2300/025; B01L 2300/044; B01L 2300/0672; B01L 2300/0681; B01L 2300/16; B01L 2300/168
See application file for complete search history.

(56) References Cited

U.S. PATENT DOCUMENTS 3,157,905 A * 11/1964 Levy ..... A45D 34/045 401/127
4,852,560 A * 8/1989 Hermann, Jr. ..... B01L 3/508 600/575
5,785,044 A * 7/1998 Meador ..... A61B 10/007 206/221
6,277,646 B1 * 8/2001 Guirguis ..... A61B 10/007 422/417
6,576,193 B1 * 6/2003 Cui ..... B01L 3/502 422/417

(Continued)

OTHER PUBLICATIONS

Medacx—Drug of Abuse Tests Publicly available website captured Feb. 22, 2019 from https://www.medacx.co.uk/products/drug-abuse-tests/doa-saliva-screen.

(Continued)

*Primary Examiner* — Samuel P Siefke
*Assistant Examiner* — Tingchen Shi
(74) *Attorney, Agent, or Firm* — Charmasson, Buchaca & Leach, LLP

(57) ABSTRACT

A specimen collection, storage, transport, and testing device can include an outer vessel containing an internal cup having an openable drain having a brim raised above the bottom floor of the cup. Once opened the drain allows a portion of liquid specimen to flow from the cup into a lower chamber of the vessel containing a number of chromatographic assay strips. A lid sealing the vessel can include a downwardly projecting guide tube having first barrier sealing a bottom aperture. An oblong initiator can axially engage the guide tube, break the first barrier and open the drain to initiate the test while retaining a pool of liquid specimen in the cup for subsequent confirmatory testing.

16 Claims, 8 Drawing Sheets

(56) References Cited

U.S. PATENT DOCUMENTS 7,387,216 B1 * 6/2008 Smith ..... B01L 3/50825 220/259.2
7,507,373 B2 3/2009 Vallejo et al.
7,758,815 B2 * 7/2010 Hartselle ..... B01L 3/502 422/400
7,981,054 B2 7/2011 Nguyen et al.
8,992,855 B2 * 3/2015 Lin ..... B01L 3/502 422/405
9,687,844 B2 6/2017 Meng et al.
2002/0046614 A1 * 4/2002 Alley ..... B01L 3/502 73/864.51
2003/0021727 A1 * 1/2003 Weyker ..... A61B 10/007 422/412
2003/0021736 A1 * 1/2003 Kang ..... A61B 10/0096 422/417
2003/0190259 A1 * 10/2003 Alley ..... A61B 10/0096 422/411
2004/0071786 A1 * 4/2004 Grippi ..... A61L 24/106 424/530
2004/0132091 A1 7/2004 Ramsey et al.
2004/0184966 A1 9/2004 Zhou et al.
2007/0287193 A1 12/2007 Pressman et al.
2009/0024055 A1 * 1/2009 Nguyen ..... A61B 10/0038 600/562
2011/0243816 A1 10/2011 Shimada
2014/0134073 A1 * 5/2014 Fuller ..... A61B 10/0051 422/411
2017/0336400 A1 * 11/2017 Meng ..... G01N 33/54366
2020/0056965 A1 * 2/2020 Gao ..... A61B 10/0096

OTHER PUBLICATIONS

International Search Report dated Sep. 3, 2020 for corresponding PCT application serial No. PCT/US202/036194, 8 pages.

* cited by examiner

SPECIMEN TESTER INCLUDING A SEPARATE INITIATOR AND METHOD

FIELD OF THE INVENTION

The invention relates to immunoassay devices for conducting chromatographic testing of liquid and liquid immersible specimens, and more particularly to devices for collection, preliminary screening, storage, and later confirmatory testing of materials such as pathological, forensic, and environmental specimens.

BACKGROUND

Liquid specimen testing containers are commonly used to collect and test liquid specimens for the presence or absence of specific "indicators" which show the presence of certain chemicals, hormones, antibodies or antigens associated with various physiological conditions and are commonly used for drug abuse screening. Such containers can also be used to store and transport portions of the specimen to a lab for subsequent, more rigorous, confirmatory testing. Such containers can also be adapted to test semi-solid material specimens such as bodily excretions, gels, and powders by mixing the specimen with one or more liquid reagents within the container. For example, devices such as shown in Nguyen, U.S. Pat. No. 7,981,054 provide for testing fecal material specimens among other possible specimens.

As disclosed in Vallejo, et al., U.S. Pat. No. 7,507,373 (hereinafter "Vallejo"), the type of preliminary screening test being conducted can be easily changed by replacing the strip-containing cartridge with one carrying a different panel of strips designed to detect a different set of indicators. Such flexibility can be important so that the same device can be used for many different types of tests, reducing manufacturing and distribution costs.

Conducting the preliminary testing often involves exposing the specimen to a number of chromatographic test strips which can release chemicals back in to the specimen, potentially contaminating the specimen for subsequent testing. Therefore, many devices such as shown in Lin, U.S. Pat. No. 8,992,855 separate the specimen into a first portion used by the device for preliminary screening and a second portion preserved for later testing. Unfortunately, such devices can include complex structures which can be more difficult and costly to manufacture and operate.

Another potential problem with some devices involves the volume of liquid specimen used to expose the strips. For some tests a narrow range of volume is preferred to maximize the accuracy of the test. In other words, the results of a test can be different depending on whether the container such as the one shown in Vallejo is returned ⅓ full versus ⅔ full. However, adjusting the volume of the specimen in a device like the one in Vallejo must be done manually or through specific instruction to the donor, and therefore can be a difficult, time-consuming, and prone to inaccuracy. Such adjustment also carries a health risk for the person conducting the test and a contamination risk to the specimen or testing media. Further, it can be important to ensure that the device provides the necessary amount or aliquot of fluid for preliminary testing while also preserving an adequate volume of the specimen for later confirmatory testing.

Another potential problem involves the timing of the initiation of the test. Often, the results of the preliminary screening test may be valid for a narrow span of time. Thus, it can be useful to prevent the donor from initiating the preliminary screening test. Although Nguyen U.S. Pat. No. 7,981,054 discloses a pull-tab which must be removed in order to initiate the test, the donor can disregard instructions and remove the tab to initiate the test prematurely, potentially reducing the accuracy of the results.

Further, some devices require the donor to carefully keep the cup upright after the specimen has been deposited. Expecting donors to remember such steps can often be overly optimistic.

Increasingly, preliminary screening tests are being performed and evaluated by relatively unskilled technicians or even the general public. Therefore, the device needs to be relatively simple to operate to ensure adequate exposure of the preliminary test strips and to provide more consistent results.

Therefore there is a need for a specimen test cup which addresses some or all of the above identified inadequacies.

SUMMARY

The principal and secondary objects of the invention are to help provide an improved specimen collection, preliminary screening, storage, and transport device. These and other objects are achieved by a vessel having a lid-mounted, sealed guide tube through which a separate test initiator can be inserted to initiate the test.

In some embodiments there is provided an assay device for testing a specimen, said device comprises: a vessel which comprises: an upper maw; and, a translucent wall portion providing visual access to a test panel; a lid releasably sealing said maw, wherein said lid comprises: a guide tube having a lumen terminating at a top aperture and a bottom aperture; and, wherein said lumen is sealed by an openable first barrier; a cup contained within said vessel, wherein said cup comprises: a top opening leading to an upper chamber; a bottom floor; a drain through said floor; wherein said drain is sealed by an openable second barrier; an initiator comprising: a stick having an upper end and a lower tip separated by a length along an axis; said tip being dimensioned to pass through said lumen; wherein said length is sufficient to allow said tip to penetrate through both of said first and second barriers when said stick is fully inserted in said guide tube; whereby fluid flows from said upper chamber, through said drain, and onto said test panel.

In some embodiments the assay device further comprises: said stick having a threaded section proximal to said upper end; said guide tube having a threaded segment proximal to said top aperture; and, wherein said threaded section threadingly engages said threaded segment.

In some embodiments the assay device further comprises: said length being further selected to allow said threaded section and said threaded segment to partially engage while said tip is located a distance separated from said second barrier.

In some embodiments the assay device further comprises: said stick having a resilient o-ring proximal to said upper end; said o-ring dimensioned to for a liquid seal between said stick and said guide tube proximal to said top aperture; said length being further selected to allow said o-ring to sealingly engage said guide tube while said tip is located a distance separated from said second barrier.

In some embodiments said drain is formed by a pedestal extending upwardly from said floor; said pedestal having a brim separated a height from said floor.

In some embodiments an axial distance between said brim and said floor is between about 3 and about 15 millimeters.

In some embodiments said first and second barriers are in substantial axial alignment.

In some embodiments said initiator, guide tube, internal cup, and drain are substantially coaxial.

In some embodiments said upper end is secured to a knob which is dimensioned to prevent passage of said knob into said lumen.

In some embodiments the assay device further comprises a filter mounting structure formed on said floor, and a filter secured to said filter mounting structure so that liquid passing through said drain also passes through said filter before reaching said lower chamber.

In some embodiments the assay device further comprises: said lid, said guide tube, and said first barrier being made from a unitary piece of material.

In some embodiments said lid seals against said vessel, said cup seals against said vessel, and said initiator seals against said lid in absence of any resilient O-rings.

In some embodiments said stick comprises one or more radial disuniformities near said tip whereby a semi-solid material can be collected in said one or more radial disuniformities.

In some embodiments said one or more radial disuniformities comprise a collector spoon near said tip wherein said spoon is dimensioned to collected a given volume of said semi-solid material.

In some embodiments said radial disuniformities are washed by a flow of said specimen through said drain.

In some embodiments said device further comprises: said guide tube forming a seal against said pedestal.

In some embodiments there is provided in an immunoassay flow testing device having a fluid specimen accepting vessel having a and an open top maw sealable by a lid, and at least one chromatographic testing strip exposed to an internal compartment of the vessel, an improvement which comprises: an internal cup contained within said vessel; a lid having a guide tube having a top aperture and a bottom aperture, wherein said guide tube is openably sealed by a first barrier; said internal cup having a drain having a brim raised above a bottom floor of said cup, said drain being openably sealed by a second barrier; wherein said bottom aperture and said drain are in substantial axial alignment; and, an oblong initiator stick having a length sufficient to penetrate through said guide tube to open said first and second barriers, thereby allowing an amount of said fluid specimen to flow through said drain, into said internal compartment and onto said at least one chromatographic testing strip.

In some embodiments there is provided a method for conducting a preliminary fluid specimen test and a secondary confirmatory test from a single fluid specimen, said method comprises: selecting a device including: an outer vessel containing a testing panel, a lid having a guide tube sealed by an openable first barrier, and an internal cup having a drain raised above a bottom floor, said drain sealed by an openable second barrier; introducing a fluid specimen into said internal cup; sealing said internal cup and said vessel with said lid; inserting an oblong stick through said guide tube; wherein said inserting comprises: sealing a top aperture of said guide tube with said oblong stick; first opening said first barrier with said oblong stick; second opening said second barrier with said oblong stick; thereby allowing a first amount of said fluid specimen to flow through said drain and onto said testing panel, and separating a second amount of said specimen having not passed through said raised drain apart from said first amount; observing a result on said testing panel; removing said lid from said cup after said observing; and, conducting said secondary confirmatory test from said second amount of said specimen.

In some embodiments the method further comprises: wherein said sealing said internal cup and said vessel with a lid comprises: engaging a portion of said guide tube to seal an amount of said fluid specimen apart from a volume of said fluid specimen remaining preserved in said internal cup; wherein said first and second opening comprises: breaking a pair of frangible obstructions forming said barriers.

In some embodiments said breaking said pair of barriers comprises a single continuous twisting motion of said oblong stick.

The original text of the original claims is incorporated herein by reference as describing features in some embodiments.

DESCRIPTION OF THE EXEMPLARY EMBODIMENTS

Figure 1:
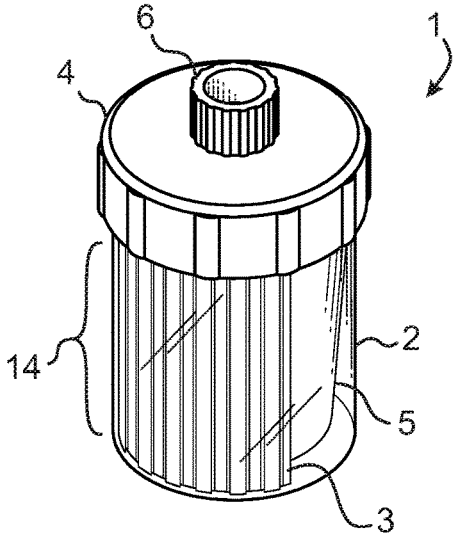
FIG. 1 is a diagrammatic, perspective view of an assembled testing device according to an exemplary embodiment of the invention.

In this specification, the references to top, bottom, upward, downward, upper, lower, vertical, horizontal, sideways, lateral, back, front, etc. can be used to provide a clear frame of reference for the various structures with respect to other structures while the testing container is in its upright orientation as shown in FIG. 1, and not treated as absolutes when the frame of reference is changed, such as when the container is laying on its side.

The term "substantially" can be used in this specification because manufacturing imprecision and inaccuracies can lead to non-symmetricity and other inexactitudes in the shape, dimensioning and orientation of various structures. Further, use of "substantially" in connection with certain geometrical shapes, such as "cylindrical", "conical", and "circular", and orientations, such as "parallel" and "perpendicular", can be given as a guide to generally describe the function of various structures, and to allow for slight departures from exact mathematical geometrical shapes and orientations, while providing adequately similar function. Those skilled in the art will readily appreciate the degree to which a departure can be made from the mathematically exact geometrical references.

Figure 2:
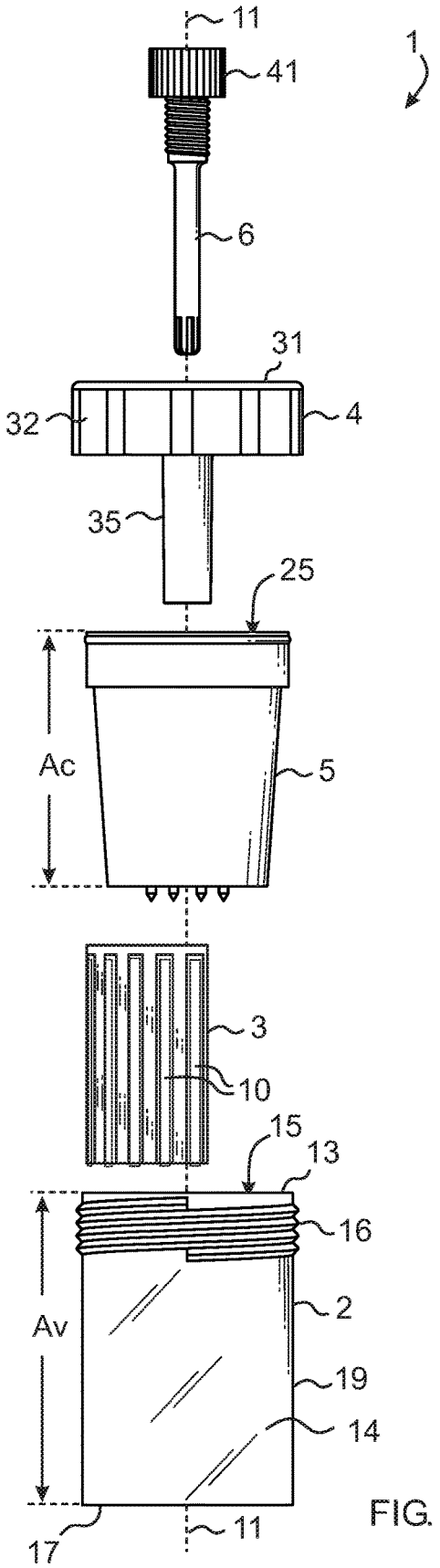
FIG. 2 is a diagrammatic, exploded, perspective view of the testing device of FIG. 1.
Figure 3:
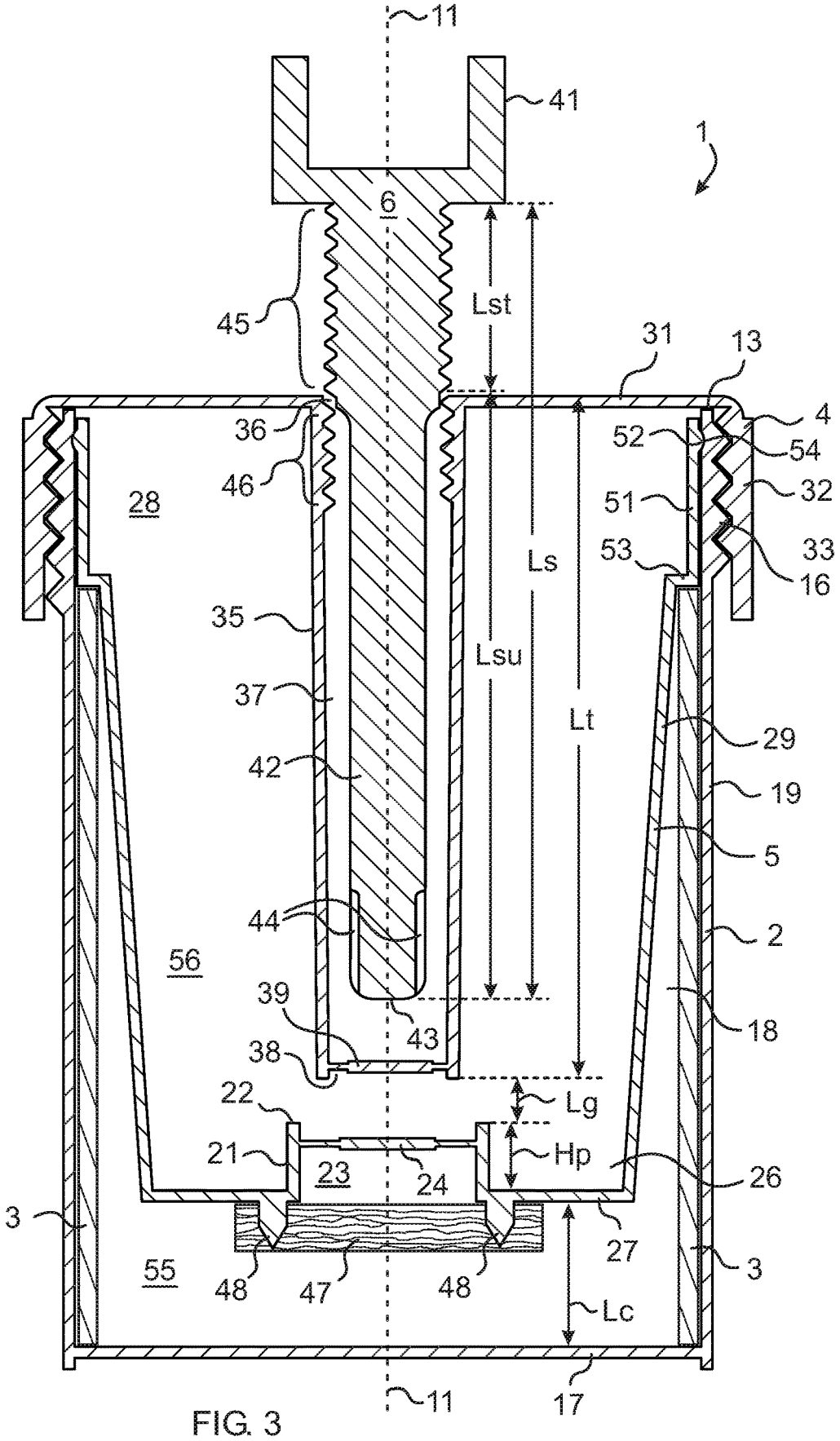
FIG. 3 is a diagrammatic cross-sectional side view of the device of FIG. 1.

Referring now to the drawing there is shown in FIGS. 1-3 a specimen collection, testing, transport, and storage device 1 for preliminarily screening a specimen such as an amount of urine for the presence of disease or abused drugs, and saving a separate amount of that specimen for later confirmatory testing. The device can include an outer container vessel 2 which can fully contain a cylindrical or semi-cylindrical test panel cartridge 3 mounting a number of chromatographic test strips 10 as shown and an internal cup 5. A lid 4 can seal the vessel, and a separate initiator 6 can be inserted through the lid to initiate the preliminary screening test. The initiator can be made unavailable to the donor so that the donor is prevented from properly initiating the test. The vessel can be made of a translucent material so that the sidewall forms a window 14 through which the strip-carrying cartridge can be viewed, revealing the results while the vessel remains sealed.

The vessel 2 can have a substantially cylindrical sidewall 19, a substantially circular open upper maw 15 separated along a central axis 11 from a substantially circular, closed lower base 17, thus enclosing a substantially cylindrical internal compartment 18. A substantially circular upper lip 13 can surround the maw.

The internal cup 5 can have a substantially circular top opening 25, a substantially circular bottom floor 27, and a substantially partially conical sidewall 29 enclosing a substantially partially conical inner compartment 28. The floor can have a central pedestal 21 in the form of a substantially cylindrical pipe having an upper brim 22 leading to a central drain 23 that is openably sealed to the flow of liquid by a drain barrier 24. The pedestal can extend an axial height Hp up from the floor, thereby creating a toroidal pool 26 surrounding the pedestal. The dimensions of the pedestal can be selected to determine the volume of the pool.

The dimension of the various structures can be readily adjusted according to various parameters such as manufacturing cost, reduced bulk, and flexibility for the number of test configurations available. For example, a cup having a volume of between about 100 and 300 milliliter, the height of the pedestal can be between about 3 and 15 millimeter, and for many typical liquid specimen testing applications, between about 3 and 5 millimeter.

The internal cup 5 can include an upper substantially cylindrical section 51 dimensioned to intimately contact and be supported against the substantially cylindrical inner surface of the sidewall 19 of the vessel 2. A radially widened bead 52 of material near the top opening 25 of the cup can engage in a snap-fit manner a corresponding groove 54 in the inner surface of the vessel. The bead can serve to secure the cup in the proper axial location within the vessel. The snap-fitting bead also acts as a seal to prevent liquid specimen from seeping out of the lower chamber 55 formed by the space between the outer surface of the cup and the inner surface of the vessel. A circumferential radially inwardly extending flange 53 at the bottom of the upper cylindrical section creates annular pocket in which the strip-carrying cartridge 3 can reside.

The internal cup 5 can be mounted substantially coaxially within the internal compartment 18 of the vessel 2. The cup can have a shorter maximum axial dimension than the axial dimension of the internal compartment of the vessel so that its floor 27 can be suspended an axial distance Lc from the upper inner surface of the base 17 of the vessel to form the lower chamber 55 which will expose the strip-carrying cartridge 3 to liquid specimen once part of the specimen is allowed to flow into the lower chamber.

The lid 4 can releasably seal the open maw 15 of the vessel 2. The lid can have a substantially circular top panel 31, surrounded by a downwardly projecting substantially cylindrical skirt 32 having internal threads 33 sized, shaped and located to threadingly engage corresponding external threads 16 surrounding and extending below the upper lip 13 of the vessel 2. A guide tube 35 can extend axially downwardly a length Lt from substantially the center of the top panel. The guide tube can have a top aperture 36 through the top panel leading to an internal lumen 37 which terminates at a bottom aperture 38 which is openably sealed by a tube barrier 39. Both the drain barrier 24 and the tube barrier 39 can be formed by frangible obstructions formed during injection molding of the cup and lid respectively.

As the lid is screwed onto the vessel, the guide tube 35 penetrates axially through the open top 25 and into the inner compartment 28 of the internal cup 5 to define an upper chamber 56 in the cup. The length Lt of the guide tube and the height Hp of the pedestal 21 can be selected to form a gap having an axial length Lg therebetween. This gap allows liquid overflowing the toroidal pool 26 to enter the inlet of the drain 23.

The initiator 6 can be separate from the lid 4, and can have a hand-graspable knob 41 secured to an oblong, substantially cylindrical stick 42 extending downwardly from the knob a given length Ls. The stick length Ls can be selected to be long enough to break both the tube barrier 39 and the drain barrier 24 when the initiator is fully engaged in the guide tube 35. Thus, the stick can have an upper end connected to the knob and lower end forming a tip 43.

The initiator 6 can advance axially downwardly into the guide tube 35 on the lid 4 by a twisting motion once the threads 45, 46 have engaged. Further twisting motion can cause the tip 43 of the stick 42 to be driven first through the guide tube barrier 39, breaking it open, then successively through the drain barrier 24, breaking it open, and allowing liquid to flow from the upper chamber 56, through the drain 23, and into the lower chamber 55. In this way, the initiator, tube, internal cup, and drain pipe can be coaxial to the central axis 11. Further, this allows the user a simple, one-step process, that being the continuous twisting the knob of the initiator, to initiate the preliminary screening test. The guide tube allows the partial insertion of the initiator before the test is initiated. It also maintains the seal of the upper chamber until the threads engage to form another seal of the lumen before the guide tube barrier seal is broken. In this way the vessel remains sealed during the entire process from prior to initiation though initiation. This protects from the escape of any specimen or smells from the vessel between the time the donor has placed the lid on the vessel and when the confirmatory technician removes the lid in the lab. Further, the guide tube guides the tip of the initiator downwardly so that the threads are in proper alignment for rapid engagement.

It shall be understood that for testing semi-solid materials, the stick 42 can have one or more radial disuniformities such as flutes 44 formed into the stick near the tip 43 to allow for the capture of semi-solid material therein. Further, the internal cup 5 can have a filter 47 extending laterally over the bottom outlet to the drain 23 which filters out larger solid or semi-solid particles from the portion of liquid passing into the lower chamber 55. The filter can be fixed in place by a filter mounting structure such as a pair of barbs 48 extending downwardly from the bottom of the floor 27 of the cup. In addition, the inner compartment 28 of the cup can be preloaded with an amount of liquid reagent that can contact the specimen carried on the flutes of the stick. At this point the mixture of the semi-solid specimen and liquid reagent can be referred to collectively as "specimen".

Another advantage of using a threaded initiator engaging a threaded guide tube is that the amount of penetration of the stick into the device can be precisely controlled. When testing semi-solid materials the screwing motion of the initiator requires an amount of time to pass between when the tip is exposed to reagent and when the drain barrier is opened. This provides time for the reagent to mix with the semi-solid specimen.

Another advantage of using a threaded initiator is that a large amount of torque can be easily applied to the initiator without risk of spilling or mishandling the device. Such torque is transmitted to the downward force on the barriers in a controlled manner.

The stick 42 of the initiator 6 can have an externally threaded section 45 near its upper end, and the remainder of the stick unthreaded including its lower end. The guide tube 35 can have internally threaded segment 46 extending below its top aperture 36. Therefore the axial length Lst of the threaded section combined with the axial length Lsu of the unthreaded section equals the length Ls of the stick. The length of the threaded section can be selected so that the threads engage prior to there being contact by the tip 43 with the tube barrier 39. Thus the length Lsu of the unthreaded section should be significantly less than the length Lt of the guide tube, and less than the axial distance from the top aperture to the tube barrier. The threaded section 45 on the stick preferably engages the threaded segment 46 on the guide tube by at least one circumference of thread so that the engages threads effectively seal the top aperture of the guide tube prior to the breaking of the tube barrier seal. In this way, the threading automatically seals the guide tube before the guide tube barrier is broken. This prevents the escape of liquid specimen from the device once the guide tube barrier has been opened.

It shall be understood that the above described arrangement of elements allows for the manufacture of the components using simple injection molding techniques from common materials such as PTFE plastics and a minimum amount of assembly which can be readily automated. Indeed, with respect to the lid, the top panel, skirt, guide tube, and guide tube barrier can all be made from a single, unitary injection molded or 3D printed piece of material. Similarly, the entire cup, including the upper section, sidewall, bead, flange, floor, pedestal, and drain barrier can all be made from a single, unitary piece of material.

Referring now to FIGS. 4-8 there will be described the method of conducting a preliminary screening test and preserving an aliquot of liquid specimen for later confirmatory testing using the device of FIGS. 1-3. In this example of the method, the device is configured for collecting and testing a urine specimen. Thus, the filter (47 in FIG. 3) has been omitted. This example also shows that the strip-carrying cartridge 59 need not extend entirely circumferentially around the sidewall 19 of the vessel 2.

Figure 4:
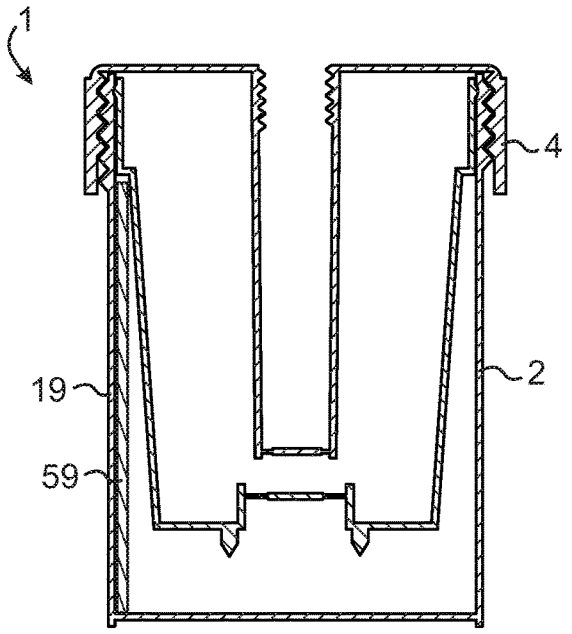
FIG. 4 is a diagrammatic cross-sectional side view of the device of FIG. 1 as it is handed to a donor configured for use in collecting a urine specimen.

As shown in FIG. 4, the device 1 can be delivered empty to the donor similarly to a standard lidded cup where the lid 4 is screwingly attached to the vessel 2.

Figure 5:
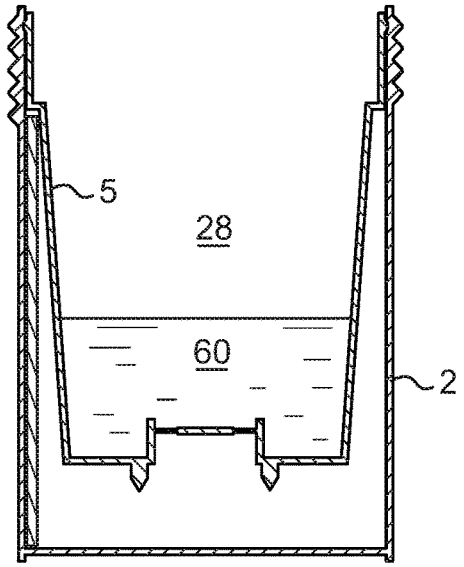
FIG. 5 is a diagrammatic cross-sectional side view of the device of FIG. 4 having its lid removed and a liquid specimen deposited therein.

As shown in FIG. 5, the donor can remove the lid and deposit a fluid specimen 60 into the inner compartment 28 of the cup 5 within the vessel 2.

Figure 6:
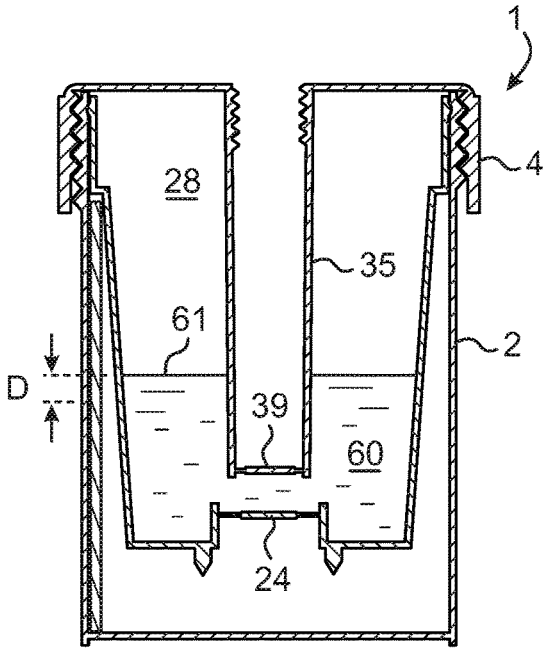
FIG. 6 is a diagrammatic cross-sectional side view of the device of FIG. 5 where the lid has been secured thereon after the fluid specimen has been deposited therein.

As shown in FIG. 6, the donor can replace the lid 4, and return the cup 1 containing the specimen 60 to the technician. It shall be noted that the surface level 61 of the liquid specimen has been raised a distance D by the immersion of the lower end of the guide tube 35 into the specimen. It is important to note that as far as the donor is concerned, the process for collecting the specimen has been no different from depositing a specimen in an ordinary lidded cup, thus keeping the process simple for the untrained donor. Having no access to the initiator, the donor cannot accidentally or intentionally initiate the preliminary screening test. In addition, it is irrelevant whether the donor tilts or shakes the device since the urine is completely trapped within the internal compartment 28 of the inner cup by the lid and intact barriers 39, 24. Because the vessel, cup, guide tube, and drain pedestal are all coaxially arranged, they remain in alignment regardless of how tight the lid is screwed onto the vessel. Thus the design can accommodate minor inaccuracies in manufacturing and the tightness with when different users attach the lid.

Figure 7:
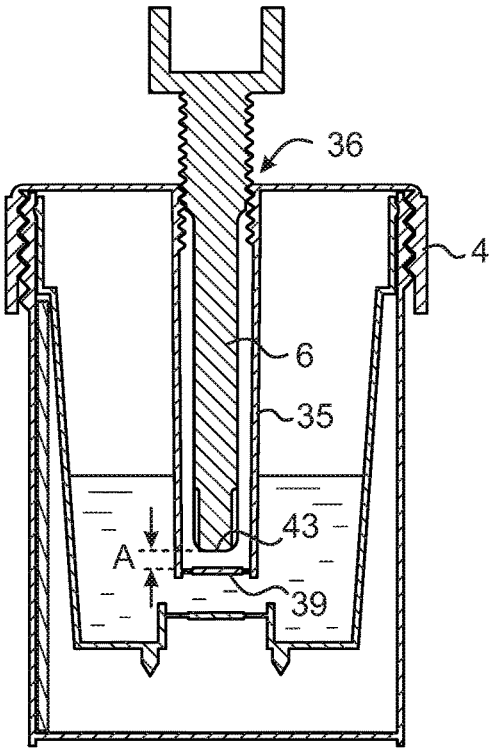
FIG. 7 is a diagrammatic cross-sectional side view of the device of FIG. 6 where the initiator has been partially inserted into the guide tube of the lid.

As shown in FIG. 7, prior to beginning the preliminary screening test, the lab technician can insert the initiator 6 into the top aperture 36 of the lid 4 until the threads engage. It shall be noted that the threads have partially engaged while the lower tip 43 of the initiator remains a distance A above the barrier 39 near the bottom of the guide tube 35.

Figure 8:
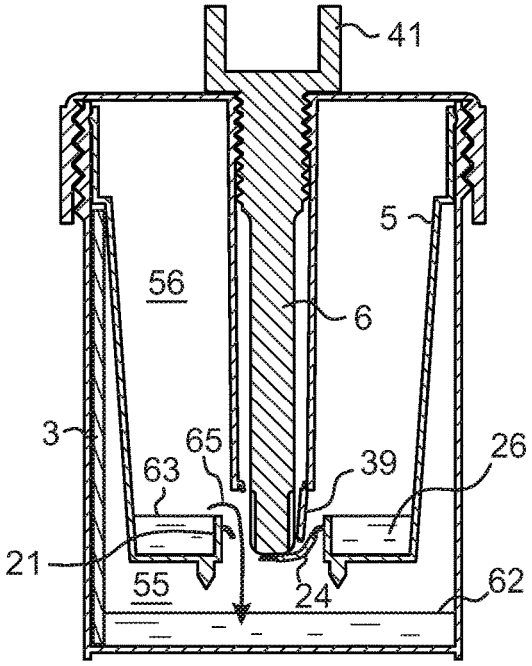
FIG. 8 is a diagrammatic cross-sectional side view of the device of FIG. 7 where the initiator has been fully screwed down, opening the barriers, and the preliminary screening conducted.

As shown in FIG. 8, the technician can then twist the initiator by its top knob 41, thereby driving the tip 43 of the initiator 6 through both barriers 39, 24, thus opening a liquid path 65 from the upper chamber 56 into the lower chamber 55, and allowing an amount 62 of specimen to flow through the drain of the cup 5, into the lower chamber and contact the strip-carrying cartridge 3. The remainder of the specimen 63, which has not contacted the strips, is trapped in the toroidal pool 26 surrounding the pedestal 21 in the upper chamber. The result of the test can be observed by the technician through the transparent sidewall of the vessel and the device stored and/or transported for later confirmatory testing. It is important to note that in this arrangement of elements, the axial location of the barriers can be selected so that the dangling guide tube barrier 24 does not interfere with the tip of the initiator reaching and breaking the drain barrier 39.

The preliminary screening test using the above described device can easily be conducted by less skilled workers or even the general public. Thus the device can be sold commercially in drug stores and be available to a much wider market.

Referring now to FIGS. 9-12 there will be described the method of conducting a preliminary screening test and preserving an aliquot of liquid specimen for later confirmatory testing using the device of FIGS. 1-3. In this example of the method the device is configured for collecting and testing a fecal specimen by the donor. Thus, the filter (47 in FIG. 3) has been included.

Figure 9:
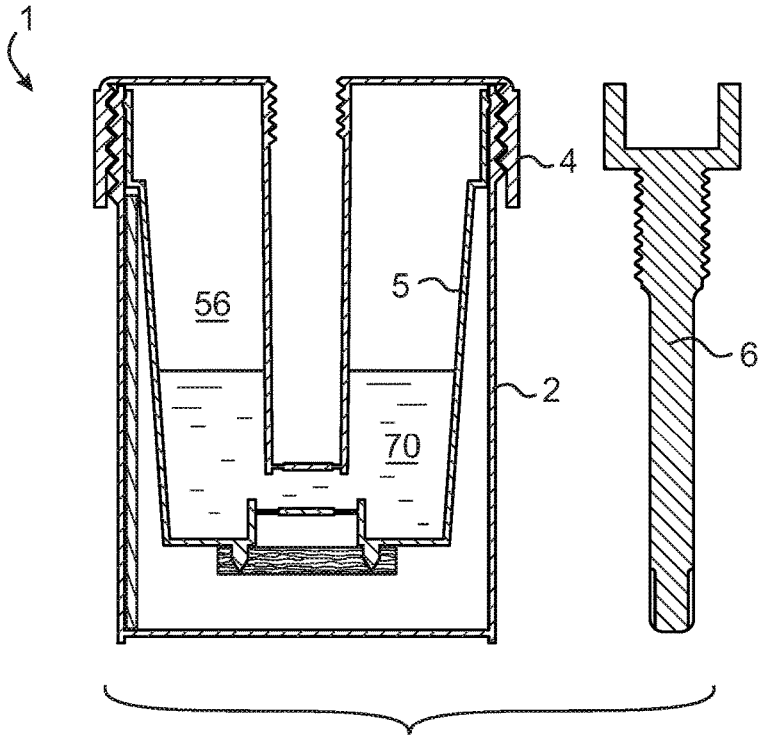
FIG. 9 is a diagrammatic cross-sectional side view of the device of FIG. 1 as it is used by a donor configured for use in collecting a fecal specimen.

As shown in FIG. 9, the device 1 can be delivered to the donor with the lid 4 screwingly attached to the vessel 2, and the initiator 6 provided separately and detached. An amount of liquid reagent 70 is preloaded into the upper chamber 56 of the internal cup 5.

Figure 10:
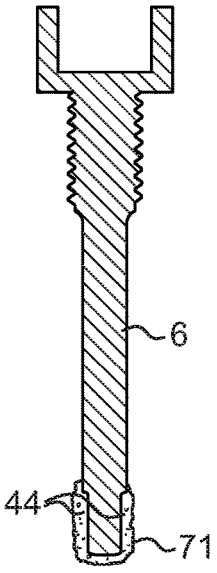
FIG. 10 is a diagrammatic cross-sectional side view of the initiator of FIG. 9 having collected a semi-solid specimen thereon.

As shown in FIG. 10, the donor can collect an amount of semi-solid specimen 71 on the flutes 44 on the lower end of the initiator 6.

Figure 11:
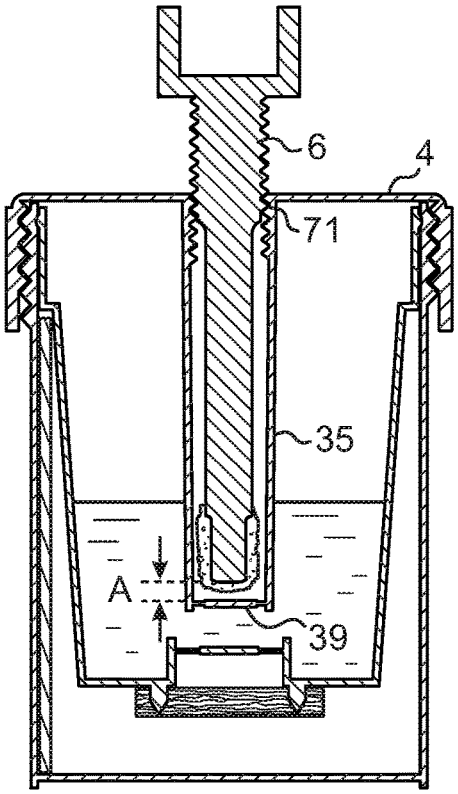
FIG. 11 is a diagrammatic cross-sectional side view of the device of FIG. 9 where the initiator has been partially inserted into the guide tube of the lid.

As shown in FIG. 11, prior to beginning the preliminary screening test, the donor can insert the initiator 6 into the top aperture of the lid 4 until the threads engage. It shall be noted that the threads have engaged 71 while the bottom tip of the initiator remains a distance A above the barrier 39 at the bottom of the guide tube 35.

Figure 12:
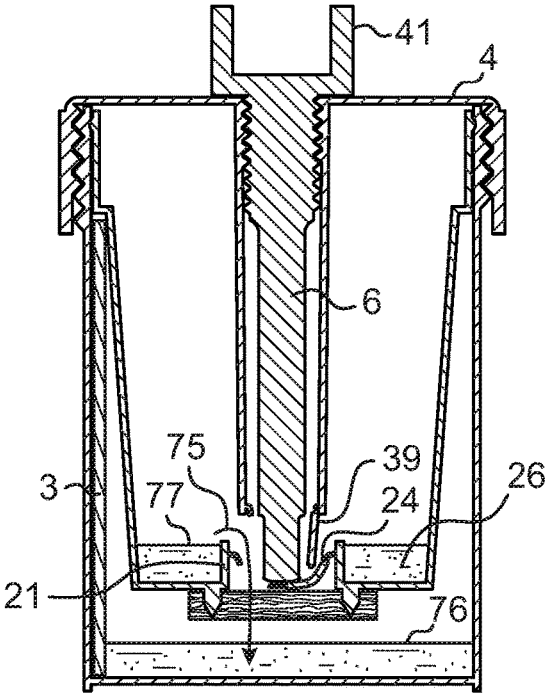
FIG. 12 is a diagrammatic cross-sectional side view of the device of FIG. 11 where the initiator has been fully screwed down, opening the barriers, and the preliminary screening conducted.

As shown in FIG. 12, the donor then twists the initiator by its top knob 41 driving the tip of the initiator 6 through the tube barriers 39 first, allowing the semi-solid material carried on the lower end of the initiator to mix with the reagent. Further twisting to the knob drives the initiator downward to break through the drain barrier 24 thus opening a liquid path 75 from the upper chamber into the lower chamber, and allowing an amount 76 of specimen to flow through the drain of the cup, into the lower chamber and contact the strip-carrying cartridge 3. The remainder of the specimen 77 is trapped in the toroidal pool 26 surrounding the pedestal 21 in the upper chamber. The result of the test can be observed through the transparent sidewall of the vessel and the device stored and/or transported for later confirmatory testing. It is important to note that the flutes 44 of the stick can be washed out by the direction of the liquid path and the force of the flow entering the drain as the tip of the initiator simultaneously enters the drain and passes into the flow.

Figure 13:
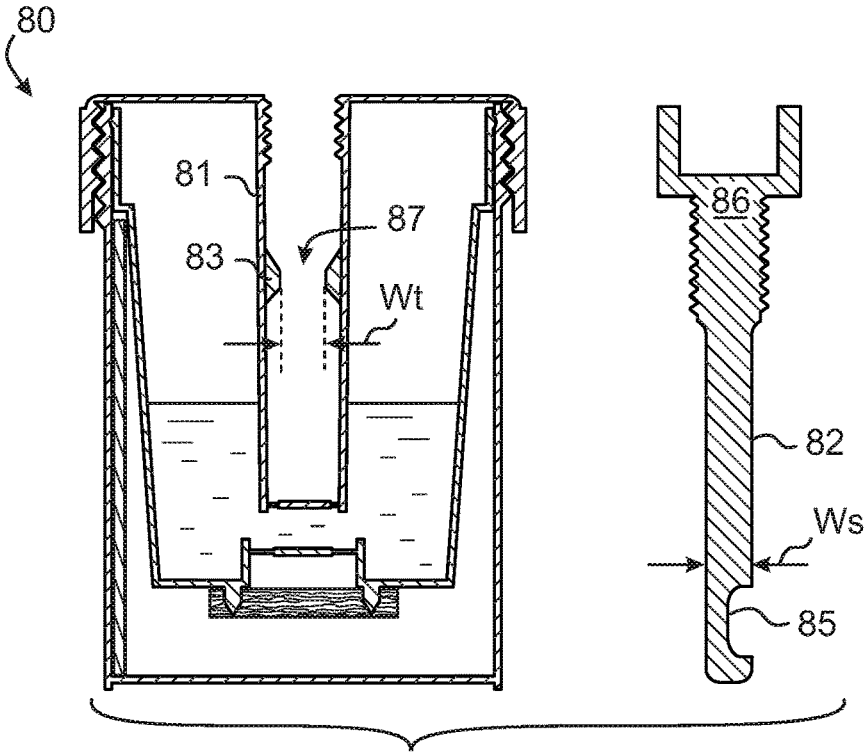
FIG. 13 is a diagrammatic cross-sectional side view of an alternate embodiment of the device where the initiator includes a quantitatively specified collector spoon.

In an alternate embodiment shown in FIG. 13, the test device 80 can be adapted to test a quantitatively limited amount of semi-solid material. The initiator 86 can have a single radial disuniformity in the form of a single divot 85 of a specified volume. The guide tube 81 can have an annular choke 83 at an axially medial location and having a center hole 87 having a diametric width Wt that is commensurate with the diametric width Ws of the lower, unthreaded end of the stick 82 of the initiator. In this way, when the stick is inserted into the guide tube, the lower end of the stick including the divot passes through the hole and scrapes away substantially all the excess material other the material contained in the divot. Thus the material entering the upper chamber has a limited maximum quantity. This can help improve the accuracy of some tests.

A plural number of different types of initiators can be provided as a kit. For example the initiator of FIG. 10 can be provided together with the initiator 86 so that the user can decide which to use given the test to be conducted.

Figure 14:
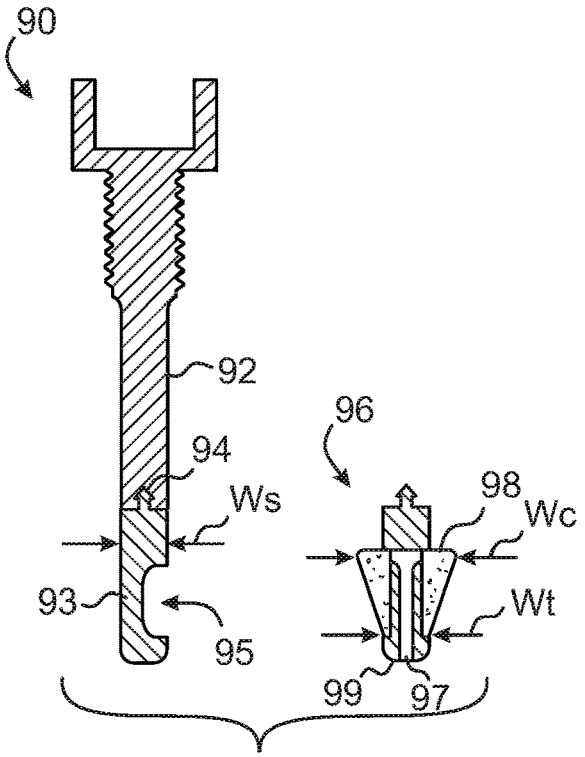
FIG. 14 is a diagrammatic cross-sectional side view of an alternate embodiment of the initiator having a set of interchangeable collector extremities.

In an alternate embodiment shown in FIG. 14, the initiator 90 can be adapted to have a replaceable lower extremity 93 which removably attaches to the stick 92 using a snap fitting 94 or other common fastener. For example, the extremity 93 having a spoon-type collector 95 can be removed and replaced with a separate extremity such as a sponge-type collector 96 useful for collecting saliva. The sponge-type collector can have a sponge 98 having a substantially conical outer surface oriented so that its narrowest end has a diametric width Wn near the tip 99 of the extremity. Its widest end has a diametric width We greater than the diametric width Wt of the center hole 87 choke 83 in the device of FIG. 13. In this way the sponge can easily be forced through the choke in a manner which squeezes the sponge to extract the saliva from it and into the central discharge channel 99 of the extremity.

Figure 15:
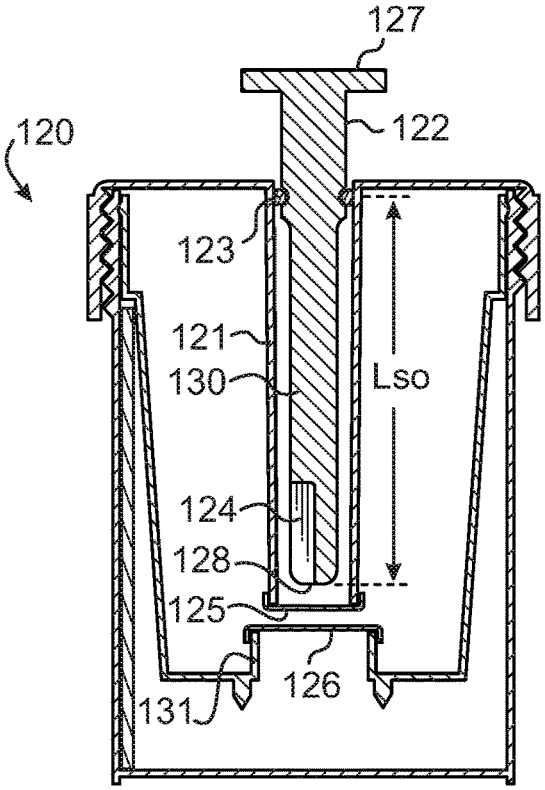
FIG. 15 is a diagrammatic cross-sectional side view of an alternate embodiment of the device where the initiator is non-threaded and the barriers are formed by frangible foil.

In another alternate embodiment shown in FIG. 15, the test device 120 can be adapted to use a non-threaded initiator 122, instead having an o-ring 123 made of resilient material such as synthetic rubber mounted on the stick 130 near the upper end which terminates in a thumb pad 127. The size of the o-ring is selected to bear compressively between the stick and the inside surface of the guide tube 121. Further, the guide tube can have a barrier 125 formed by a cap of plastic-backed foil adhesively sealed over the bottom aperture of the guide tube. Similarly, the drain barrier 126 can be formed by a plastic-backed foil cap adhesively sealed over the brim of the pedestal 131. The length of the stick and the axial position of the o-ring is selected so that the o-ring is located a distance Lso from the lower tip 128 that is less than the length of the guide tube from its upper aperture to its lower aperture. In this way, when the stick engages the lumen of the guide tube the o-ring seals the lumen before the tip can penetrate the guide tube barrier. The tip of the stick has at least one flute which is shaped and dimensioned to allow liquid to pass therethrough in the event that the foil barriers are penetrated in such a way that the hole through the barrier is circular having a diameter matching the stick near the tip. In other words the flute forms a passageway for liquid to flow through the barrier.

Figure 16:
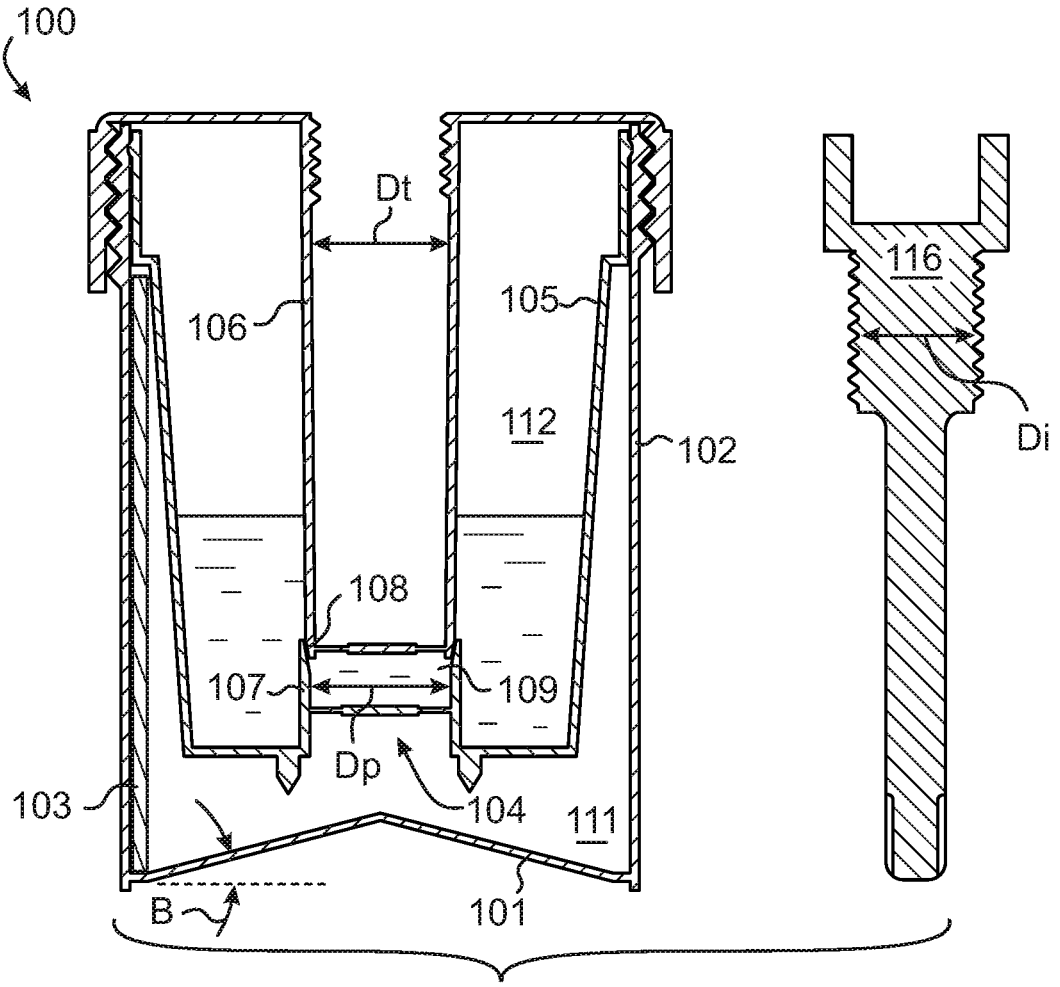
FIG. 16 is a diagrammatic cross-sectional side view of an alternate embodiment of the device where the guide tube seals to the central cup pedestal.

In another alternate embodiment shown in FIG. 16, the test device 100 can be adapted to quantify the volume of liquid specimen 109 being delivered to the lower chamber 111 to contact the strip-carrying cartridge 103, and to prevent any liquid from the lower chamber reentering the upper chamber 112 by traveling back through the drain 104. In this embodiment the guide tube 106 can seal against the pedestal 107 extending upwardly from the floor of the internal cup 105. Sealing can be accomplished by selecting the outer diameter Dt of the guide tube to be substantially commensurate with the inner diameter Dp of the pedestal. Because the guide tube and pedestal are substantially cylindrical and centrally located, they are automatically in substantial coaxial alignment regardless of the angular orientation of the lid. In this way the guide tube can engage and seal against the drain while the lid is screwed into place upon the vessel. Corresponding surfaces forming the interface 108 of the guide tube and the pedestal can be beveled or otherwise shaped to facilitate insertion of the guide tube into the pedestal. By choosing a gradually beveled edges, the interface can be substantially partially conical so that the seal between them becomes tighter as the lid is screwed into place. This allows for coarser tolerances in manufacturing since the seal can be maintained within a range of relative axial positions of the lid and cup. It shall be understood that the interface can also include additional seal enhancing structures such as a radially widened bead of material engaging a corresponding groove similar to the sealing structures bead and groove 52, 54 structures sealing the cup to the vessel in the embodiment of FIG. 3.

Once the seal between the guide tube 106 and the pedestal 107 is made, the drain 104 is cut off from the upper chamber 112, and the amount of liquid specimen caught in the drain forms a quantified volume of liquid 109 to be sent to the lower chamber 111 for preliminary screening, and the amount of liquid trapped in the upper chamber becomes the aliquot preserved for later confirmatory testing.

The initiator 116 engages the guide tube 106 and breaks both barriers in the same manner as provided in the embodiment of FIGS. 1-3. For ease of manufacturing the guide tube can be substantially cylindrically shaped. Thus the threaded section of the initiator can have a diameter Di commensurate with the diameter of the corresponding threaded segment of the guide tube. When the initiator breaks the two barriers, the liquid 109 trapped in the drain drops down into the lower chamber 111 and on to the strip-carrying cartridge 103. Because the volume of liquid trapped can be relatively small, the base 101 of the vessel 102 can be ramped, for example it can have a substantially conical shape which, through gravity, drives the liquid in the lower chamber toward the periphery and the cartridge. The conical base can have an angle B of between about 5 to 30 degrees. In this way, no amount of sloshing can cause liquid from the lower chamber to reenter the upper chamber.

Although the above embodiments show the strip-carrying cartridge being mounted against the inner surface of the vessel, those skilled in the art will readily appreciate how the cartridge could instead be mounted to the outer surface of the cup.

Figure 17:
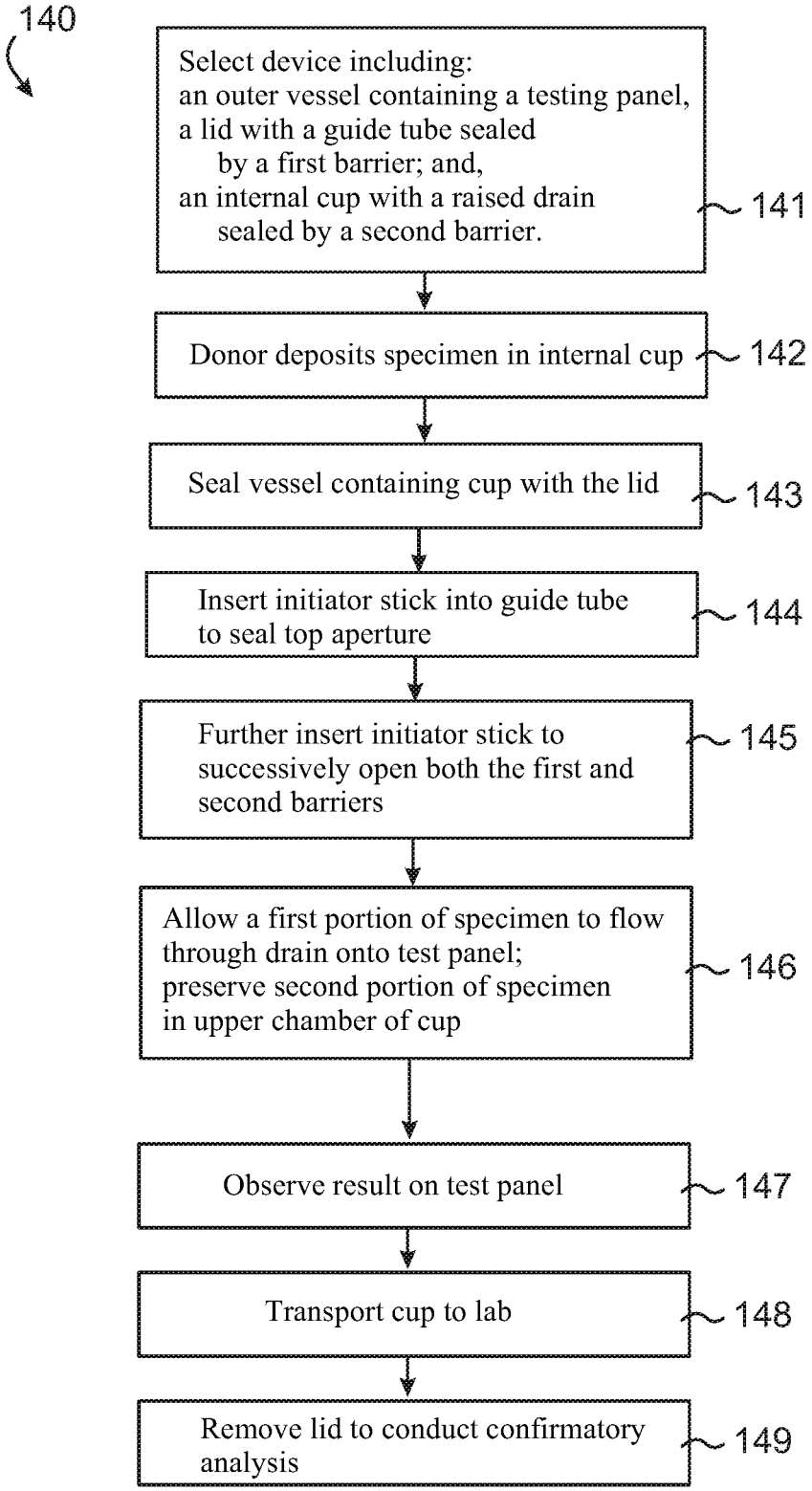
FIG. 17 is a flow diagram of method steps according to an exemplary embodiment of the invention.

FIG. 17 shows the steps 141-149 of an exemplary method 140 for conducting a preliminary screening test and confirmatory analysis using the cup of FIGS. 1-3. The method can include selecting 141 a device including: an outer vessel containing a testing panel, a lid having a guide tube sealed by an openable first barrier, and an internal cup having a drain raised above a bottom floor, where the drain is sealed by an openable second barrier. The specimen is then introduced into the internal cup by the donor depositing 142 the specimen. The vessel containing the cup with the specimen is then sealed 143 with the lid. Next, the preliminary screening is initiated by first inserting 144 the oblong stick of the initiator into the guide tube in order to seal the top aperture of the guide tube. Next, the stick is further inserted 145 into the guide tube in order first open the first barrier, and then to open the second barrier using the stick. When both barriers are open, part of the fluid specimen is then allowed 146 to flow through the drain and onto the testing panel, while a second amount of said specimen having not passed through the drain remains preserved in the cup in the upper chamber apart from the first amount in the lower chamber. Once an adequate amount of time has passed the result of the preliminary screening test can be observed 147 on the testing panel. The entire vessel including the engaged initiator can then be transported 148 to a lab, where the lid can be removed 149 and secondary confirmatory testing conducted on the remaining preserved specimen.

While the exemplary embodiments of the invention have been described, modifications can be made and other embodiments may be devised without departing from the spirit of the invention and the scope of the appended claims.

What is claimed is:

1. An assay device for testing a specimen, said device comprises:

a vessel which comprises:

an upper maw; and, a translucent wall portion providing visual access to a test panel;

a lid releasably sealing said maw, wherein said lid comprises:

a guide tube having a lumen terminating at a top aperture and a bottom aperture;

wherein said bottom aperture is sealed by an openable first barrier; and, wherein said lid, said guide tube, and said first barrier are made from a unitary piece of material;

a cup contained within said vessel, wherein said cup comprises:

a top opening leading to an upper chamber;

a bottom floor;

a drain through said floor;

wherein said drain is sealed by an openable second barrier;

an initiator separate from said lid, said initiator comprising:

a stick having an upper end and a lower tip separated by a length along an axis;

said tip being dimensioned to pass through said lumen;

wherein said length is sufficient to allow said tip to penetrate through both of said first and second barriers when said stick is fully inserted in said guide tube;

whereby fluid flows from said upper chamber, through said drain, and onto said test panel.

2. The device of claim 1, which further comprises:

said stick having a threaded section proximal to said upper end;

said guide tube having a threaded segment proximal to said top aperture; and, wherein said threaded section threadingly engages said threaded segment.

3. The device of claim 2, which further comprises: said threaded section and said threaded segment being partially engaged while said tip is located a distance separated from said second barrier.

4. The device of claim 1, which further comprises:

said stick having a resilient o-ring proximal to said upper end;

said o-ring dimensioned to form a liquid seal between said stick and said guide tube proximal to said top aperture;

said length being further selected to allow said o-ring to sealingly engage said guide tube while said tip is located a distance separated from said second barrier.

5. The device of claim 1, wherein said drain is formed by a pedestal extending upwardly from said floor toward said guide tube; said pedestal having a brim separated a height from said floor.

6. The device of claim 5, wherein an axial distance between said brim and said floor is between about 3 and about 15 millimeters.

7. The device of claim 1, wherein said first and second barriers are in substantial axial alignment.

8. The device of claim 7, wherein said initiator, guide tube, internal cup, and drain are substantially coaxial.

9. The device of claim 1, wherein said upper end is secured to a knob which is dimensioned to prevent passage of said knob into said lumen.

10. The device of claim 1, which further comprises a filter mounting structure formed on said floor, and a filter secured to said filter mounting structure so that liquid passing through said drain also passes through said filter before reaching said lower chamber.

11. The device of claim 1, wherein said lid seals against said vessel, said cup seals against said vessel, and said initiator seals against said lid in absence of any resilient O-rings.

12. The device of claim 1, wherein said stick comprises one or more radial disuniformities near said tip whereby a semi-solid material can be collected in said one or more radial disuniformities.

13. The device of claim 12, wherein said one or more radial disuniformities comprise a collector spoon near said tip wherein said spoon is dimensioned to collect a given volume of said semi-solid material.

14. The device of claim 12, wherein said radial disuniformities are washed by a flow of fluid through said drain.

15. The device of claim 5, wherein said device further comprises: said guide tube forming a seal against said pedestal.

16. In an immunoassay flow testing device having a fluid specimen accepting vessel having an open top maw sealable by a lid, and at least one chromatographic testing strip exposed to an internal compartment of the vessel, an improvement which comprises:

an internal cup contained within said vessel;

a lid having a guide tube having a top aperture and a bottom aperture, wherein said bottom aperture is openably sealed by a first barrier;

wherein said lid, said guide tube, and said first barrier are made from a unitary piece of material;

said internal cup having a drain having a brim raised above a bottom floor of said cup, said drain being openably sealed by a second barrier;

wherein said bottom aperture and said drain are in substantial axial alignment; and, an oblong initiator stick separate from said lid, said oblong initiator stick having a length sufficient to penetrate through said guide tube to open said first and second barriers, thereby allowing an amount of said fluid specimen to flow through said drain, into said internal compartment and onto said at least one chromatographic testing strip.

* * * * *